US005738622A

United States Patent [19]

Niinai et al.

[11] Patent Number: 5,738,622

[45] Date of Patent: Apr. 14, 1998

[54] CENTRIFUGAL SEPARATOR AND A METHOD OF DETECTING UNBALANCE OF A ROTOR

[75] Inventors: Yoshitaka Niinai; Shoji Kusumoto; Tsutomu Takamura; Noriyasu Matsufuji, all of Hitachinaka, Japan

[73] Assignee: Hitachi Koki Co., Ltd., Japan

[21] Appl. No.: 651,590

[22] Filed: May 22, 1996

[30] Foreign Application Priority Data

Jun. 16, 1995 [JP] Japan ..... 7-150727

[51] Int. Cl.[6] ..... B04B 13/00

[52] U.S. Cl. ..... 494/7; 494/10; 494/37

[58] Field of Search ..... 494/1, 7, 9, 10, 494/11, 12, 16, 82, 84, 37; 210/144, 363; 318/460, 470; 68/23.1, 23.3, 12.06

[56] References Cited

U.S. PATENT DOCUMENTS

| | | | |
|---|---|---|---|
| 2,895,023 | 7/1959 | Blum | 494/16 X |
| 3,676,723 | 7/1972 | Drucker | 318/466 X |
| 4,099,667 | 7/1978 | Uchida | 494/82 X |
| 4,214,179 | 7/1980 | Jacobson et al. | 494/7 X |
| 4,491,019 | 1/1985 | Wicki et al. | 494/7 X |
| 4,700,117 | 10/1987 | Giebeler et al. | 494/7 X |
| 4,910,502 | 3/1990 | Serveau et al. | 210/144 X |
| 4,972,110 | 11/1990 | Gorodissky et al. | 494/10 X |
| 5,160,876 | 11/1992 | Niinai et al. | 318/460 |
| 5,496,254 | 3/1996 | Keller et al. | 494/7 |

FOREIGN PATENT DOCUMENTS

| | | | |
|---|---|---|---|
| 82956 | 7/1983 | European Pat. Off. | 494/10 |
| 1287945 | 2/1987 | U.S.S.R. | 494/82 |

*Primary Examiner*—Charles E. Cooley

*Attorney, Agent, or Firm*—Parkhurst & Wendel, L.L.P.

[57] ABSTRACT

A centrifugal separator comprising: a rotor for containing a sample; a rotating unit; a detection circuit for detecting a distance between a reference position and a position of the rotor and generating a distance detection signal; a rectifying circuit for half-wave rectifying the distance detection signal; a judging circuit for judging the distance detection signal from the rectifying circuit; and a controller for controlling the rotating unit in accordance with a judging result of the judging circuit and a corresponding method are disclosed. The judging circuit judges whether the distance is in a balanced condition of or an unbalance condition of the rotor. A centrifugal separator comprising: the rotor; the rotating unit; a detection circuit, having a given detection range, for detecting a distance between a reference position and a position of the rotor and generating the distance detection signal, the given range covering a deflection range of the rotor due to whirling on the side of the detection circuit with respect to a rotational axis of the rotor; the judging circuit for judging the detection signal and the controller for controlling the rotating unit and a corresponding method are also disclosed. The detection range may be assigned to an inhibit deflection range due to whirling of the rotor.

5 Claims, 5 Drawing Sheets

CENTRIFUGAL SEPARATOR AND A METHOD OF DETECTING UNBALANCE OF A ROTOR

BACKGROUND OF THE INVENTION

This invention relates to a centrifugal separator having a rotor and a method of detecting unbalance of a rotor of a centrifugal separator.

A centrifugal separator having a rotor for containing a sample to be separated, a motor for rotating the rotor, having a shaft, a drive circuit for driving the motor through the shaft, and a detector for detecting unbalance of the rotor through detecting a distance between the detector and the shaft during rotating to protect this centrifugal separator is known. FIG. 7 is an illustration of prior art centrifugal separator wherein a motion of shaft 3 of this prior art centrifugal separator to a distance detector 4 is shown. FIG. 8 is a graphical drawing of the prior art centrifugal separator showing a waveform of a distance detection signal. FIG. 9 is a graphical drawing of the prior art centrifugal separator showing a relation between a voltage of a distance detection signal and a distance L. A distance detector 4 detects a distance L between a surface of the shaft 3 of the rotor and the distance detector 4 through detecting an eddy current loss with a predetermined detection range to generate a distance detection signal. As shown in FIG. 7, when the rotor rotates with balance, the shaft rotates at a position i, that is, at an axis of the rotor. However, if the rotor rotates in an unbalanced condition, the shaft revolves or whirls around the position i, so that the shaft travel along a locus 11. Therefore, the detector 4 detects the distance L and generates the distance detection signal having a sinusoidal wave as shown in FIG. 8. Positions "e", "f", "g", and "h" of the shaft 3 in FIG. 7 are so represented as to correspond to points "e'", "f'", "g'", and "h'" as shown in FIG. 8. The distance detector 4 has a predetermined linear range L1 to L2, so that a position of the distance detector 4 is determined at a position having a distance L3 from the distance detector 4, which is middle between the predetermined detection range L1 and L2. Therefore, the distance detector 4 can always detects the distance L while the shaft revolves within the predetermined detection range.

SUMMARY OF THE INVENTION

The object of the present invention is to provide an improved centrifugal separator and an improved method of detecting the unbalance of a rotor of centrifugal separator.

According to the present invention there is provided a first centrifugal separator comprising: a rotor for containing a sample to be separated; a rotating unit for rotating the rotor; a detection circuit for detecting a distance between a reference position and a position of the rotor and generating a distance detection signal indicative of the distance; a half-wave rectifying circuit for half-wave rectifying the distance detection signal; a judging circuit for judging the distance detection signal from the half-wave rectifying circuit; and a controller for controlling the rotating unit in accordance with a judging result of the judging circuit. The judging circuit judges whether the rotor is in a balanced condition or an unbalance condition of the rotor.

According to the present invention, there is also provided a second centrifugal separator comprising: a rotor for containing a sample to be separated; a rotating unit for rotating the rotor, the rotor having an allowable range of whirling thereof around an axis of the rotor and an inhibit range outside the allowable range; a detection circuit, having a predetermined detection range, for detecting a distance between a reference position and a position of the rotor and generating a distance detection signal indicative of the distance, the predetermined detection range covering at least the inhibit range in a radial direction; a judging circuit for judging the distance detection signal from the detection circuit; and a controller for controlling the rotating unit in accordance with a judging result of the judging circuit. In the second centrifugal separator, the judging circuit judges whether the detection signal indicates whether the rotor whirls in the allowable range or in the inhibit range. In the second centrifugal separator, the judging circuit may judge the detection signal by comparing the detection signal with a predetermined value.

According to an embodiment of the invention which comprises a rotor for containing a sample to be separated; a rotating unit for rotating the rotor; a detection circuit, having a predetermined detection range, for detecting a distance between a reference position and a position of the rotor and generating a distance detection signal indicative of the distance, the predetermined detection range covering a deflection range of the rotor due to whirling on the side of the detection circuit with respect to a rotational axis of the rotor; a judging circuit for judging the distance detection signal from the detection circuit; and a control circuit for controlling the rotating unit in accordance with a judging result of the judging circuit. In the third centrifugal separator, the judging circuit may judge whether the detection signal indicates whether the rotor whirls in the allowable range or in the inhibit range by comparing the detection signal with the predetermined value.

According to another embodiment of the invention a method of controlling a centrifugal separator having a rotor for containing a sample to be separated and rotating means for rotating the rotor, comprising the steps of: detecting a distance between a reference position and a position of the rotor and generating a distance detection signal indicative of The distance; half-wave rectifying the distance detection signal; judging the rectified distance detection signal; and controlling rotating of the rotor in accordance with the judging result.

According to still another embodiment of the invention there is a method of controlling a centrifugal separator having a rotor for containing a sample to be separated and rotating means for rotating the rotor which has an allowable range of whirling thereof around an axis of the rotor and an inhibit range outside The allowable range, comprising the steps of: detecting a distance between a reference position and a position of the rotor and generating a distance detection signal indicative of the distance within a predetermined detection range, the predetermined detection range covering at least the inhibit range in a radial direction; judging the distance; and controlling the rotation of the rotor in accordance with the judging result.

According to invention, there is a method of controlling a centrifugal separator having a rotor for containing a sample to be separated and rotating means for rotating the rotor, comprising the steps detecting a distance between a reference position and a position of the rotor and generating a distance detection signal indicative of the distance within a predetermined detection range which covers a deflection range of the rotor due to whirling on the side of the detecting the distance with respect to a rotational axis of the rotor; judging the distance; and controlling the rotation of the rotor in accordance with the judging result.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Figure 1:
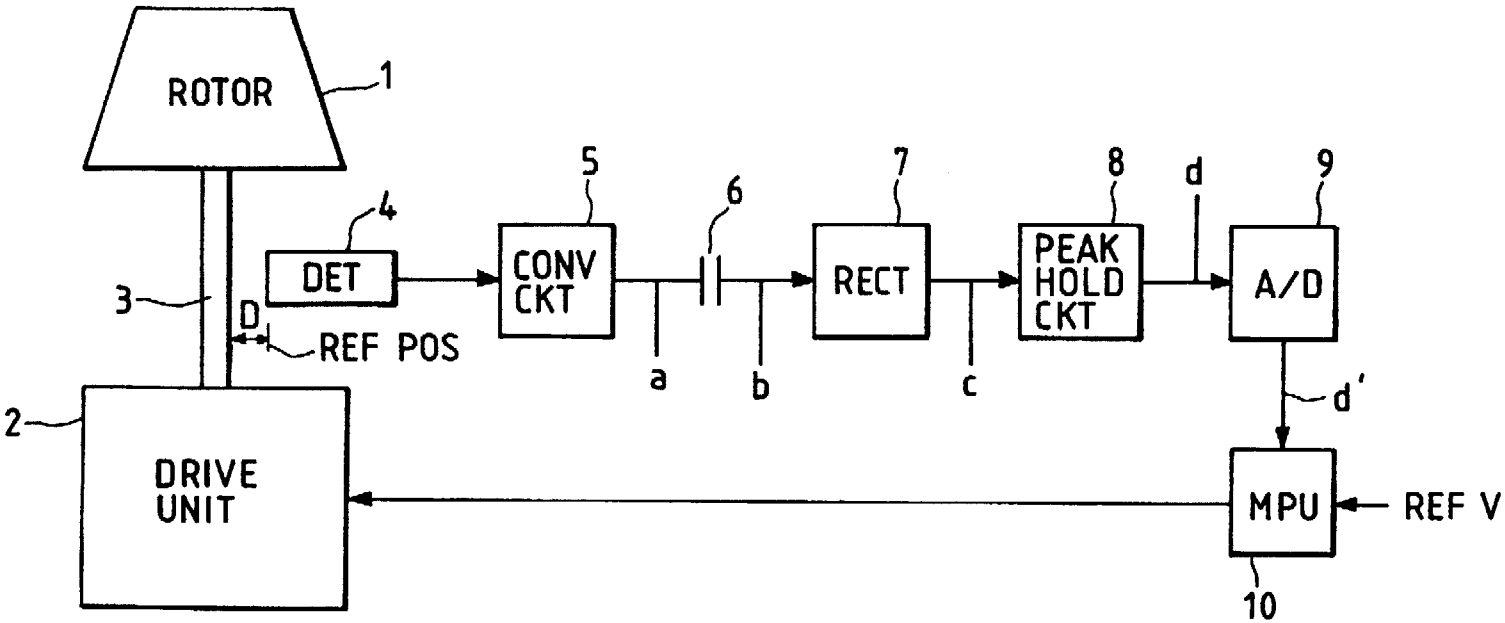
FIG. 1 is a block diagram of a centrifugal separator of this invention.
Figure 2:
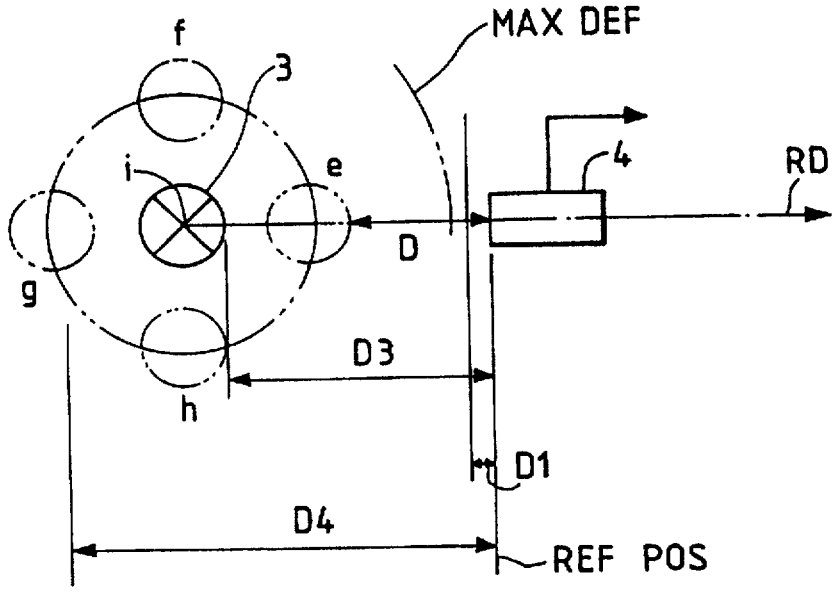
FIG. 2 is an illustration of the centrifugal separator of a first embodiment showing a positional relation of the distance detector and the shaft shown in FIG. 1.
Figure 3A:
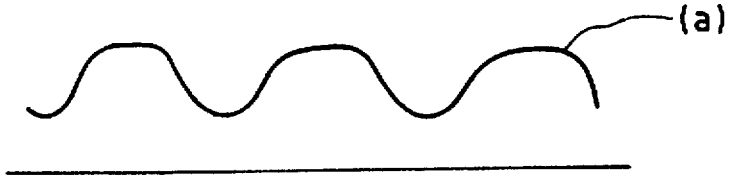
FIGS. 3*a*–3*d* are graphical diagrams of the first embodiment showing waveforms of output signals of elements shown in FIG. 1.
Figure 3B:
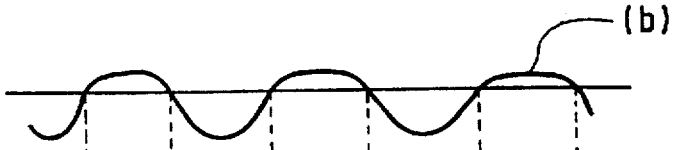
Figure 3C:
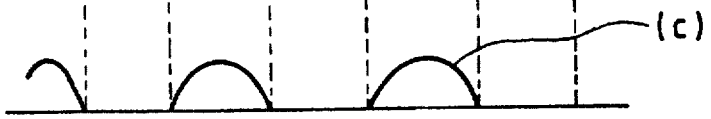
Figure 3D:
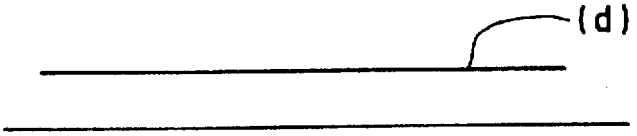

Prior to describing embodiments of this invention, a principle of this invention will be described. As shown in FIGS. 1 and 2 vibration of a rotor, of a centrifugal separator due to an unbalanced condition of the rotor 1 provides a circular movement of the rotor 1 and a circular movement or whirling movement of a shaft 3 for connecting the rotor to a drive motor 2. That is, the rotor 1 pivots on the axis of the drive motor 2. Therefore, the unbalanced condition can be detected by detecting a deflection of the rotor 1 or the shaft 3 in only one radial direction. The deflection in the opposite direction is not detected. This provides a larger detection range of detecting the unbalanced condition of the rotor 1 with the same distance detector 4 for detecting a distance between the rotor 1 and the detector 4.

Hereinbelow will be described a first embodiment of this invention.

FIG. 1 is a block diagram of a centrifugal separator of this embodiment.

The centrifugal separator of this embodiment comprises a rotor 1, having a shaft 3, for containing a sample to be separated, a drive unit 2 for rotating the rotor 1 through the shaft 3, a distance detector 4 for detecting a distance D between the distance detector, i.e., a reference position, and a surface of the shaft 3, a converting circuit 5 for converting an output of the distance detector 4 to a voltage signal "a", a coupling capacitor 6 for cutting a dc component in the voltage signal and outputting an ac component "b" in the voltage signal, a half wave rectifying circuit 7 for half-wave-rectifying the ac component of the voltage signal, a peak hold circuit 8 for holding a peak level "d" in the output "c" of the half wave rectifying circuit 7, an a/d converter 9 for a/d-converting an output of the peak hold circuit 8, and a microprocessor (MPU) 10, having a RAM and a ROM (not shown) therein, for judging an output of the a/d converter 9 to detect an unbalance condition of the rotor 1 and controlling the drive unit 2 to control or stop the rotation of the rotor 1 when an unbalance condition exceeds a predetermined degree, that is the peak level exceeds a reference value REF V.

Figure 4:
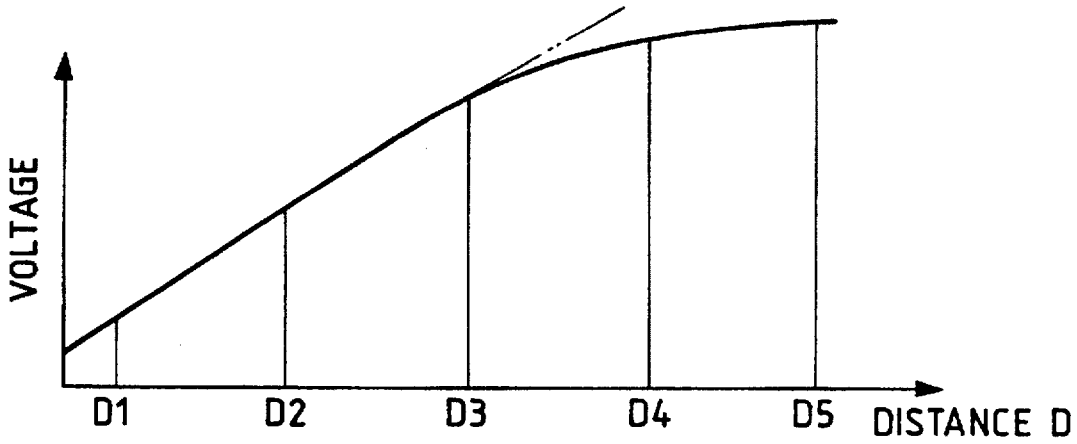
FIG. 4 is a graphical drawing of the first embodiment showing a relation between an output voltage of the distance detector and the reference position.

FIG. 2 is an illustration of the centrifugal separator of the first embodiment wherein the distance between the surface of the shaft 3 and the distance detector 4 is shown. FIGS. 3*a*–3*d* are graphical diagrams of the first embodiment showing waveforms of output signals a, b, c, d shown in FIG. 1. FIG. 4 is a graphical drawing of the first embodiment showing a relation between an output voltage of the distance detector 4 and the reference position REF POS.

The distance detector 4 has a linear range D1–D3 and a non-linear range D3–D4 wherein the voltage signal saturates at a distance D5. The distance detector 4 is so positioned as to assign the linear detection range D1–D3 to a region between the surface of the shaft when the surface of the shaft positions at a maximum deflection circle MAX DEE and the position of the surface of the shaft when the shaft positions at a rotational axis "i" of the rotor. The distance detector 4 detects the distance D between the reference position REF POS and the surface of the shaft 3 in only one radial direction RD with the linear range D1–D3.

There are various types of distance detectors, such as the eddy current loss type, the electrostatic type, and the optical type. In this embodiment an eddy current loss type of a distance detector is used.

An operation of the centrifugal separator of the first embodiment will be described.

The rotor 1, having the shaft 3, containing the sample to be separated, is rotated by the drive unit 2 through the shaft 3. The distance detector 4 detects the distance D between the distance detector, i.e., the reference position REF POS, and the surface of the shaft 3. The converting circuit 5 converts the output of the distance detector 4 to the voltage signal "a". When the rotor 1 rotates in the unbalanced condition, the rotor 1 and the shaft 3 whirl and the surface of the shaft 3 shows a circular movement. Therefore, the distance between the surface of the shaft 3 and the distance detector 4 varies. The voltage signal "a" from the converting circuit 5 varies with the variation of the distance D. The coupling capacitor 6 cuts a dc component in the voltage signal "a" and transfers an ac component "b" in the voltage signal "a" indicative of variation of the distance D. The half-wave rectifying circuit 7 half-wave-rectifies the ac component "b" of the voltage signal "a". The peak hold circuit 8 holds a peak level of the output "c" of the half wave rectifying circuit 7 and outputs a dc level indicative of the detected peak level "d" The a/d converter 9 a/d-converts the output of the peak hold circuit 8 and outputs a peak value "d'" The microprocessor 10 judges the peak value "d" to detect an unbalance condition of the rotor 1 through comparing the peak value "d'" with a reference value REF V and controls the drive unit 2 to control or stop the rotation of the rotor 1 when the unbalance condition exceeds a predetermined degree, that is, the peak value "d'" exceeds the reference value REF V.

The distance detector 4 is fixed near but outside the maximum deflection circle and the converting circuit 5 outputs the voltage signal "a" as shown by a waveform shown in FIG 3(*a*). The waveform of FIG. 3(*a*) shows that when the surface of the shaft 3 is on the side of the detector 4 with respect to the rotational axis "i" of the drive unit 2, the distance detector 4 shows a linear characteristic, so that the voltage signal "a" shows a sinusoidal form (lower side portions of the waveform FIG. 3(*a*)). However, while the surface of the shaft 3 is on the opposite side of the detector 4 with respect to the rotational axis of the drive unit 2, the voltage signal shows a distorted sinusoidal form (upper side portions of the waveform FIG. 3(*a*)). The capacitor 6 outputs the ac component "b" as shown by a waveform FIG. 3(*b*). The half-wave-rectifier 7 rectifies and provides the output as shown by a waveform FIG. 3(*c*). The peak level detector detects the peak level "d" of the output of the half-wave-rectifier 7 and outputs the dc voltage indicative of the peak level as shown by a waveform FIG 3(*d*). The microprocessor 10 compares the peak value from the a/d converter 9 with the reference value REF V to detect the unbalance condition of the rotor 1. When the microprocessor 10 detects the unbalance condition, that is, the peak value is larger than the reference value REF V, the microprocessor 10 controls the drive unit 2 to stop rotation of the rotor 1 or decrease the rotation speed of the rotor 1.

In place of the peak hold circuit 8, an RMS/DC converter (not shown) for converting a root mean value of an input signal into a dc voltage can be used.

According to the first embodiment invention there is provided a first centrifugal separator comprising: the rotor 1 for containing a sample (not shown) to be separated, the drive unit 2 as a rotating unit for rotating the rotor 1, the distance detector 4 as a detection circuit for detecting the distance D between the reference position REF POS and the position of the rotor (the surface of the shaft 3) and generating the distance detection signal "a" indicative of the distance D, the half-wave rectifying circuit 7 for half-wave rectifying the distance detection signal "a", the MPU 10 as a judging circuit and a controller for judging the distance detection signal from the half-wave rectifying circuit 7 and for controlling the drive unit 2 in accordance with the judging result. The MPU 10 judges whether the distance D is in the balanced condition of the rotor 1 or the unbalanced condition of the rotor 1.

According to another embodiment of the invention, as illustrated in

Figure 5:
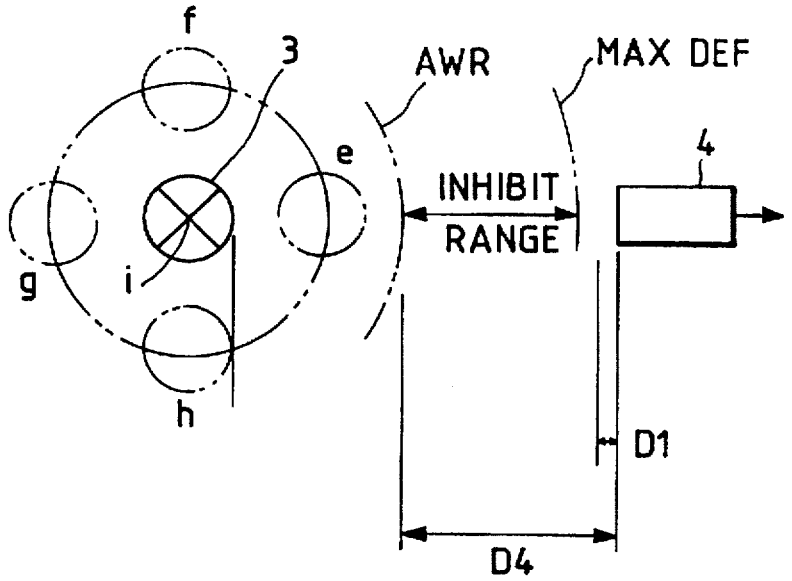
FIG. 5 is an illustration of the centrifugal separator of a second embodiment showing a positional relation of the distance detector and the shaft.

FIG. 5, which depicts a positional relation of the distance detector 4 and the shaft 3.

The centrifugal separator of this embodiment has substantially the same structure as the first embodiment. A difference is in that the distance detector 4 is so positioned as to assign the measurable range D1–D4 to an outside portion of an allowable whirling range AWR of the rotor 1 on the side of the distance detector 4 to detect that the surface of the shaft deflects over the allowable range AWR. That is, when the shaft 3 whirls over the allowable range AWR, the distance detector 4 detects the distance between the surface of the shaft 3 and the reference position REF POS and the microprocessor 10 judges that the shaft 3 whirls over the allowable range AWR and the shaft 3 is in an unbalanced condition through comparing the output of the a/d converter 9 with the reference value. Then, the microprocessor 10 controls the drive unit 2 to stop the rotor 1 or decrease the rotation speed of the rotor 1 and effects a necessary operation such as alerting and informing the operator of the detected unbalance with the alarm circuit 11 and the indicator 12. The reference value supplied to the microprocessor 10 is set to be a value corresponding to the peak value at the distance D4.

According to the second embodiment there is provided the centrifugal separator comprising the rotor 1 for containing a sample to be separated, the drive unit 2 as a rotating unit for rotating the rotor 1, the rotor 1 having an allowable range AWR of whirling thereof around an axis "i" of the rotor 1 and an inhibit range around the allowable range, the distance detector 4 as a detection circuit, having a predetermined detection range, for detecting a distance between a reference position REF POS and a position of the rotor 1 and generating a distance detection signal indicative of the distance, the predetermined detection range covering at least the inhibit range in a radial direction, the MPU 10 as a judging circuit and a controller For judging the distance detection signal From the detection circuit and for controlling the drive unit in accordance with the judging result.

Figure 6:
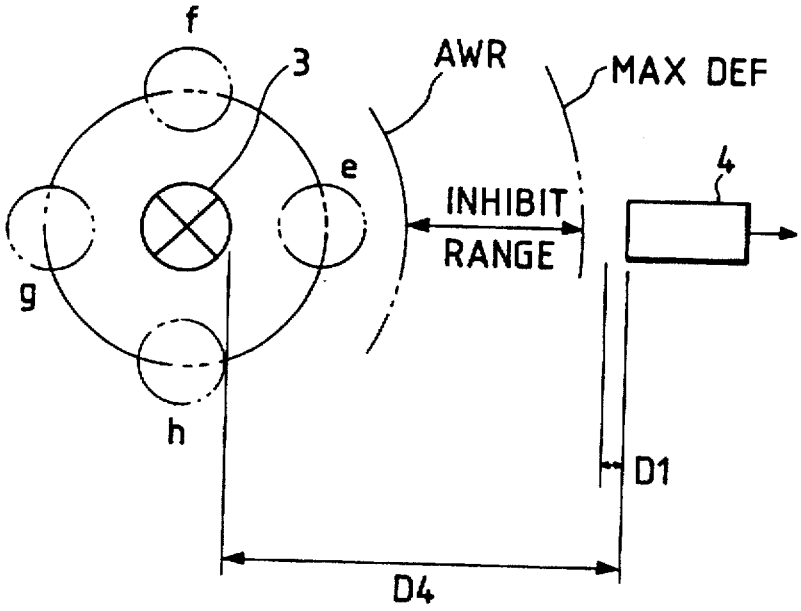
FIG. 6 is a modification of the second embodiment showing a positional relation of the distance detector and the shaft.
Figure 7:
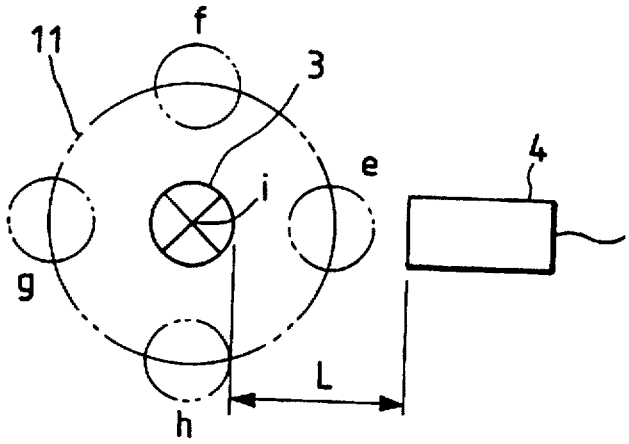
FIG. 7 PRIOR ART
FIG. 7 is an illustration a prior art centrifugal separator wherein a motion of a shaft of the prior art centrifugal separator with respect to a distance detector is shown.
Figure 8:
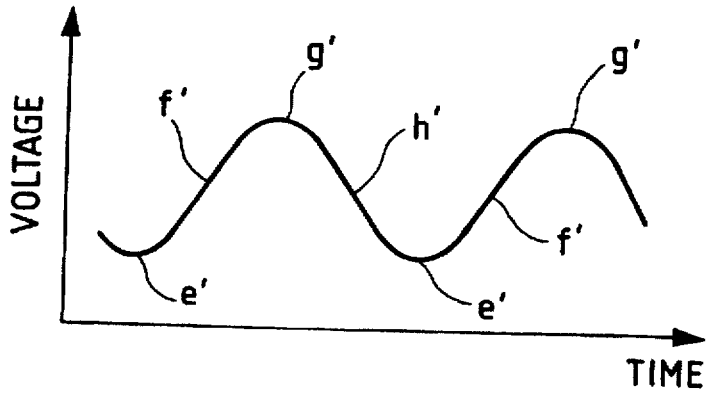
FIG. 8 PRIOR ART
FIG. 8 is a graphical drawing of the prior art centrifugal separator showing a waveform of a distance detection signal.
Figure 9:
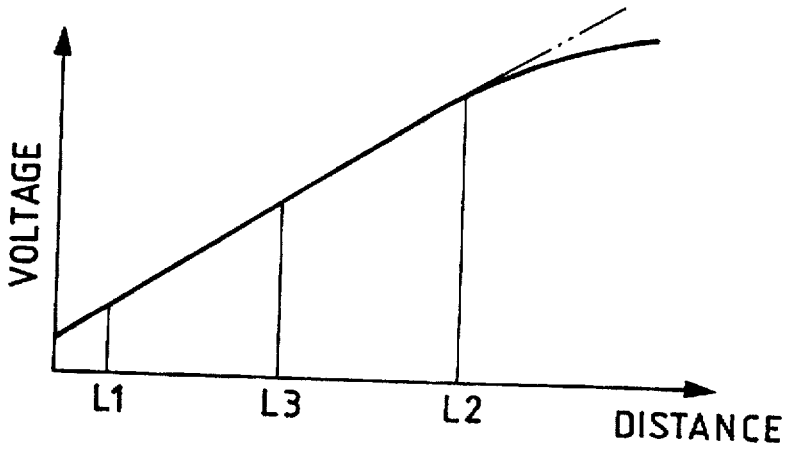
FIG. 9 PRIOR ART
FIG. 9 is a graphical drawing of the prior art centrifugal separator showing a relation between a voltage of a distance detection signal and a distance.

FIG. 6 is a modification of the second embodiment showing a positional relation of the distance detector 4 and the shaft 3. In the second embodiment, the measurable range D1–D4 is assigned to the inhibit range. However, the measurable range can be assigned to a portion of the allowable range. That is, the measurable range D1–D4 can be assigned to the range from the inhibit range to the axis "i" of the rotor 1. In other words, the measurable range is arranged to only the side of the distance detector 4 with respect to the axis "i" of the rotor 1. Other structure is the same as the second embodiment.

According to the modification of the second embodiment, there is provided the centrifugal separator comprising the rotor 1 For containing a sample to be separated, the drive unit 2 as a rotating unit for rotating the rotor 1, the distance detector 4 as a detection circuit, having a predetermined detection range, for detecting a distance between a reference position and a position of the rotor 1 and generating a distance detection signal "a" indicative of the distance, the predetermined detection range D1–D4 covering a deflection range MAX DEF of the rotor 1 due to whirling on the side of the distance detector 4 with respect to a rotational axis "i" of the rotor 1, the MPU 10 as a judging circuit and a controller for judging the distance detection signal from the detection circuit and for controlling the drive unit in accordance with a judging result. The MPU 10 judges whether the detection signal indicates the rotor whirls in the allowable range or in the inhibit range.

What is claimed is:

1. A centrifugal separator comprising:

a rotor for containing a sample to be separated;

rotating means for rotating said rotor;

detection means for detecting a distance between a reference position of said detection means and a position of said rotor, and generating a distance detection signal indicative of said distance;

a half-wave rectifying circuit for half-wave rectifying said distance detection signal;

judging means for judging said distance detection signal from said half-wave rectifying circuit; and control means for controlling said rotating means in accordance with a judging result of said judging means.

2. A centrifugal separator as claimed in claim 1, wherein said judging means judges whether said distance is in a balanced condition of said rotor or an unbalanced condition of said rotor.

3. A method of controlling a centrifugal separator having a rotor for containing a sample to be separated and rotating means for rotating said rotor, comprising the steps of:

detecting a distance between a reference position of said detection means and a position of said rotor and generating a distance detection signal indicative of said distance;

half-wave rectifying said distance detection signal;

judging said rectified distance detection signal; and controlling rotating of said rotor in accordance with the judging result.

4. A centrifugal separator comprising:

a rotor for containing a sample to be separated;

rotating means for rotating said rotor;

detection means having a detection range for detecting a distance between a reference position of said detection means and a surface of said rotor, and generating and outputting a distance detection signal indicative of said distance, wherein said distance is within said detection range when said rotor stops, said distance is within said detection range at a first position when said rotor deflects maximally toward said detection means, and said distance is outside said detection range when said rotor deflects maximally at a second position diametrically opposite to said first position.

5. The centrifugal separator according to claim 4, further comprising:

a half-wave rectifying circuit for half-wave rectifying said distance detection signal to detect said distance only on the side of said detection means with respect to said rotor;

judging means for judging said distance detection signal from said half-wave rectifying circuit; and control means for controlling said rotating means in accordance with a judging result of said judging means.

* * * * *